US008794320B2

(12) United States Patent
Ayirala et al.

(10) Patent No.: US 8,794,320 B2
(45) **Date of Patent: *Aug. 5, 2014**

(54) WATER INJECTION SYSTEMS AND METHODS

(75) Inventors: Subhash Chandra Bose Ayirala, Houston, TX (US); Robert Wing-yu Chin, Katy, TX (US); Michael Alvin Curole, Baton Rouge, LA (US); Eugene Bruce Greene, Sheridan, WY (US)

(73) Assignee: Shell Oil Company, Houston, TX (US)

( * ) Notice: Subject to any disclaimer, the term of this patent is extended or adjusted under 35 U.S.C. 154(b) by 780 days.

This patent is subject to a terminal disclaimer.

(21) Appl. No.: 12/425,311

(22) Filed: Apr. 16, 2009

(65) Prior Publication Data

US 2010/0243246 A1 Sep. 30, 2010

Related U.S. Application Data

(63) Continuation-in-part of application No. 12/295,183, filed as application No. PCT/US2007/064608 on Mar. 22, 2007.

(60) Provisional application No. 60/786,274, filed on Mar. 27, 2006.

(51) Int. Cl.
*E21B 43/24* (2006.01)
*E21B 43/16* (2006.01)
*E21B 43/40* (2006.01)
*E21B 43/20* (2006.01)

(52) U.S. Cl.
CPC ..... *E21B 43/20* (2013.01); *E21B 43/40* (2013.01)
USPC ..... 166/272.3; 166/268

(58) Field of Classification Search
None
See application file for complete search history.

(56) References Cited

U.S. PATENT DOCUMENTS

| | | | | |
|---|---|---|---|---|
| 7,455,109 | B2 * | 11/2008 | Collins | 166/275 |
| 2007/0102359 | A1 * | 5/2007 | Lombardi et al. | 210/639 |
| 2010/0006283 | A1 * | 1/2010 | Collins et al. | 166/261 |

FOREIGN PATENT DOCUMENTS

| | | | | |
|---|---|---|---|---|
| WO | WO2009/012378 | * | 1/2009 | B01D 61/00 |

* cited by examiner

*Primary Examiner* — Angela M DiTrani

(57) ABSTRACT

A system comprising a well drilled into an underground formation comprising hydrocarbons; a production facility at a topside of the well; and a water production facility connected to the production facility; wherein the water production facility produces water by removing some multivalent ions, then removing some monovalent ions, and then adding back some multivalent ions, and then injects the water into the well.

29 Claims, 4 Drawing Sheets

Figure 1 - Prior Art

WATER INJECTION SYSTEMS AND METHODS

RELATED APPLICATIONS

This application is a continuation in part of co-pending U.S. application Ser. No. 12/295,183, filed Sept. 29, 2008, which is a national stage application and claims priority from International Application No. PCT/US2007/064608, filed on Mar. 22, 2007, which claims priority from U.S. Provisional Patent Application Ser. No. 60/786,274, filed on Mar. 27, 2006.

FIELD OF INVENTION

The present disclosure relates to systems and methods for injecting water into a hydrocarbon bearing formation.

BACKGROUND

Oil accumulated within a subterranean oil-bearing formation is recovered or produced therefrom through wells, called production wells, drilled into the subterranean formation. A large amount of such oil may be left in the subterranean formations if produced only by primary depletion, i.e., where only formation energy is used to recover the oil. Where the initial formation energy is inadequate or has become depleted, supplemental operations, often referred to as secondary, tertiary, enhanced or post-primary recovery operations, may be employed. In some of these operations, a fluid is injected into the formation by pumping it through one or more injection wells drilled into the formation, oil is displaced within and is moved through the formation, and is produced from one or more production wells drilled into the formation. In a particular recovery operation of this sort, seawater, field water or field brine may be employed as the injection fluid and the operation is referred to as a waterflood. The injection water may be referred to as flooding liquid or flooding water as distinguished from the in situ formation, or connate water. Fluids injected later can be referred to as driving fluids. Although water is the most common, injection and drive fluids can include gaseous fluids such as air, steam, carbon dioxide, and the like.

Water may be injected by itself, or as a component of miscible or immiscible displacement fluids. Sea water (for offshore wells) and brine produced from the same or nearby formations (for onshore wells) may be most commonly used as the water source.

GB Patent Specification Number 1,520,877, filed Oct. 14, 1974, discloses that secondary recovery of oil from a permeable stratum is effected using as a drive fluid water whose ionic compositions and/or ionic concentration has been adjusted in a reverse osmosis desalination plant so that the water is compatible with the stratum and the connate water associated therewith. Seawater is treated by the reverse osmosis desalination plant to remove a major proportion of the divalent or higher valency ions and to have its ionic concentration adjusted either by mixing the filtrate and concentrate in predetermined proportions or by recycling the concentrate from each cycle at a higher feed pressure. Particles having a diameter of at least 1 micron may initially be removed by ultrafiltration apparatus.

U.S. Patent Application 2003/0230535 discloses a method and well for desalinating saline aquifer water, wherein saline aquifer water flows from a subsurface aquifer layer directly into a downhole aquifer inflow region of a desalinated water production well in which a downhole assembly of one or more desalination and/or purification membranes is arranged, which separate the saline aquifer water into a primary desalinated water stream which is produced through the well to surface and a secondary concentrated brine reject stream, which can be disposed into a subsurface brine disposal zone.

Referring to FIG. 1, there is illustrated prior art system 100. System 100 includes body of water 102, underground formation 104, underground formation 106, and underground formation 108. Production facility 110 may be provided at the surface of body of water 102. Well 112 traverses body of water 102 and formation 104, and has openings in formation 106. A portion of formation 106 may be fractured and/or perforated as shown at 114. Oil and gas may be produced from formation 106 through well 112, to production facility 110. Gas and liquid may be separated from each other, gas may be stored in gas storage 116 and liquid may be stored in liquid storage 118.

There is a need in the art for improved systems and methods for producing oil and/or gas from a subterranean formation. In particular, there is a need in the art for systems and methods for providing an improved water flood.

SUMMARY OF THE INVENTION

One aspect of the invention provides a method comprising removing some multivalent ions from water; removing some monovalent ions from water; adding some multivalent ions to the water; and injecting the water into an underground formation.

One aspect of the invention provides a system comprising a well drilled into an underground formation comprising hydrocarbons; a production facility at a topside of the well; a water production facility connected to the production facility; wherein the water production facility produces water by removing some multivalent ions, then removing some monovalent ions, and then adding back some multivalent ions, and then injects the water into the well.

Another aspect of the invention provides a system comprising a first well drilled into an underground formation; a production facility at a topside of a first well; a water production facility connected to the production facility; a second well drilled into the underground formation; wherein the water production facility produces water by removing some ions, and injects the water into the second well and into the underground formation.

DETAILED DESCRIPTION OF THE INVENTION

Figure 1:
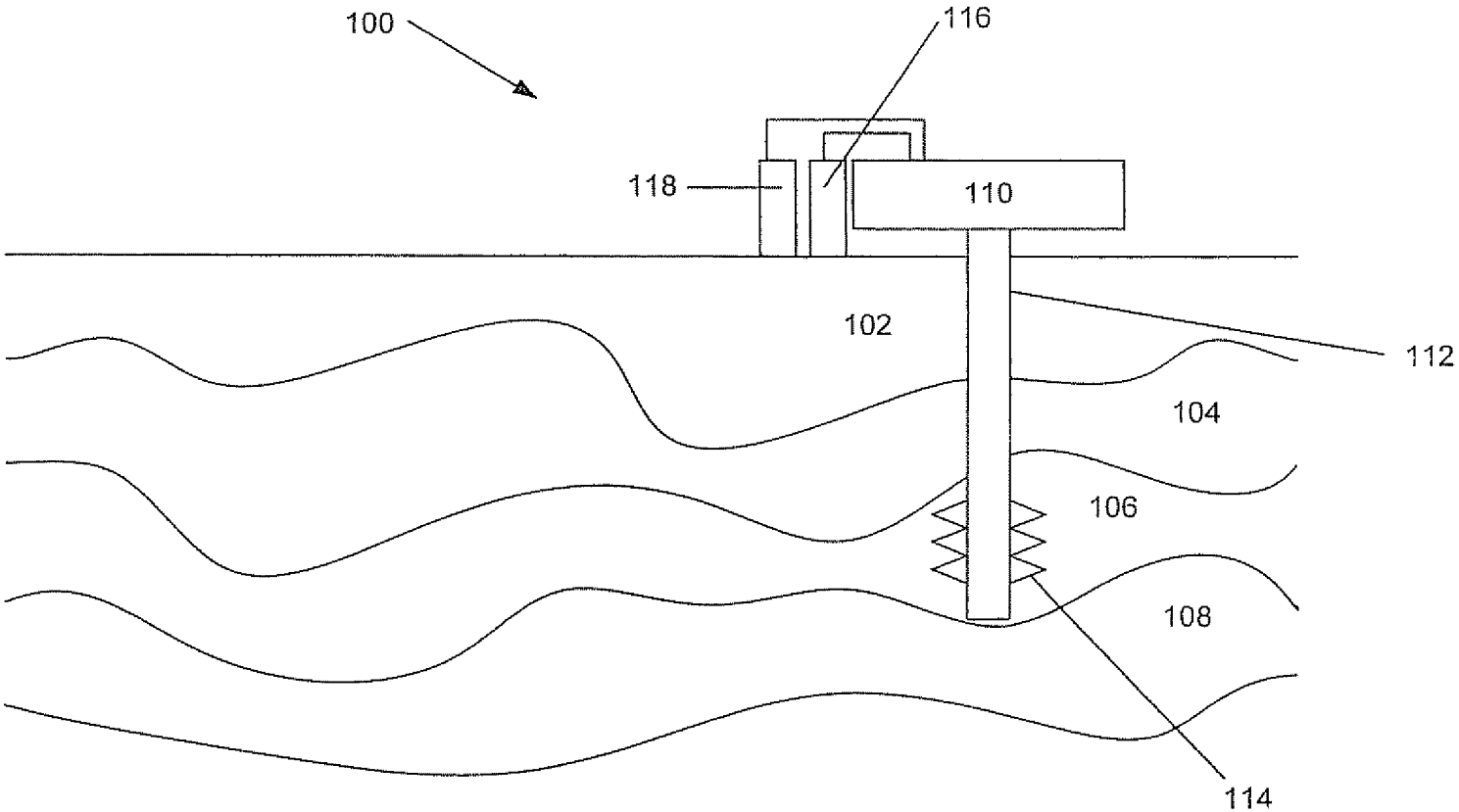
FIG. 1 illustrates a prior art oil and gas production system.
Figure 2:
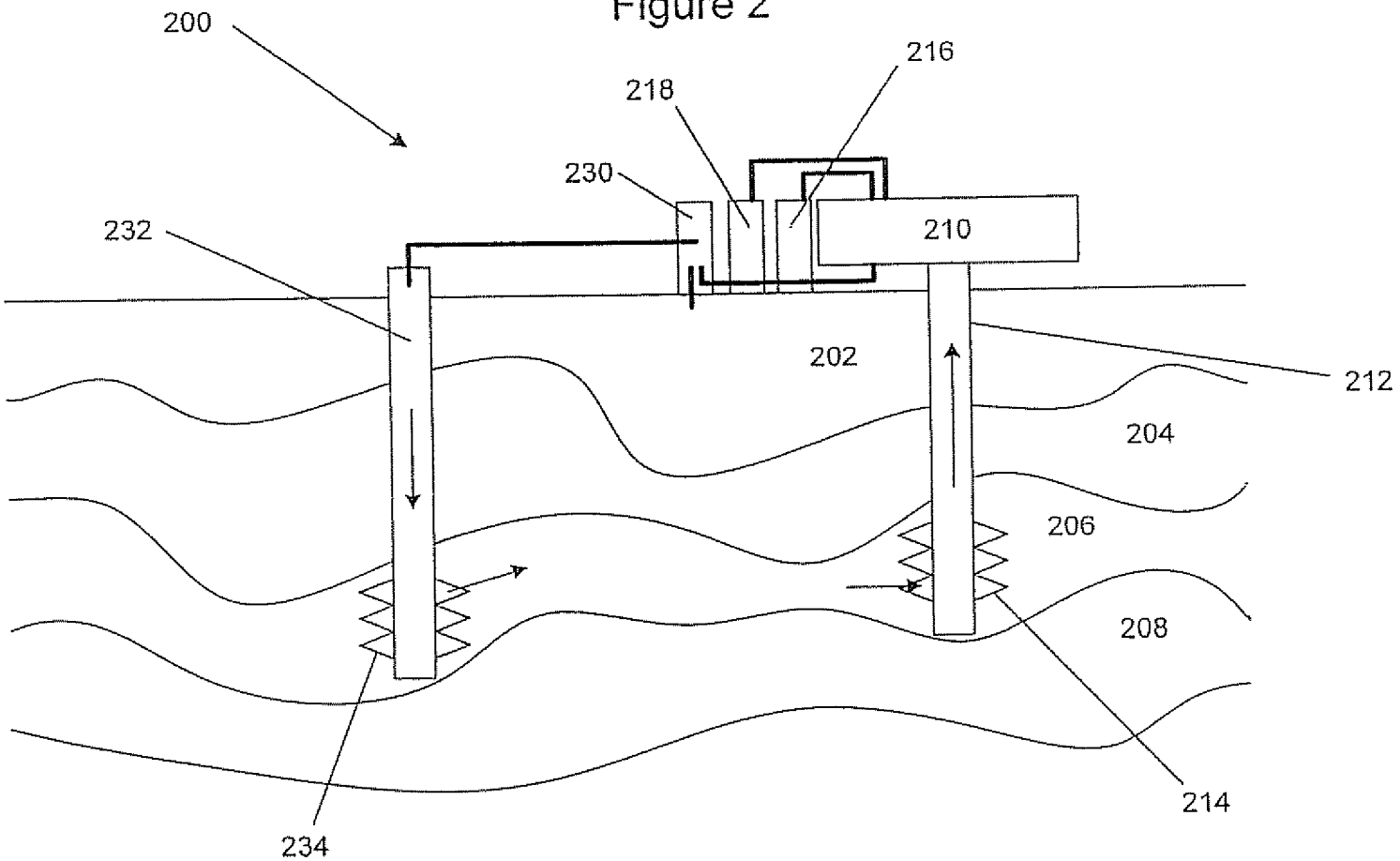
FIG. 2 illustrates an oil and gas production system.

Referring now to FIG. 2, in one embodiment of the invention, system 200 is illustrated. System 200 includes body of water 202, formation 204, formation 206, and formation 208. Production facility 210 may be provided at the surface of body of water 202. Well 212 traverses body of water 202 and formation 204, and has openings at formation 206. Portions of formation 214 may be fractured and/or perforated. As oil and gas is produced from formation 206 it enters formation portions 214, and travels up well 212 to production facility 210. Gas and liquid may be separated, and gas may be sent to gas storage 216, and liquid may be sent to liquid storage 218, and water may be sent to water production 230. Production facility 210 is able to process water, for example from body of water 202 and/or well 212, which may be processed and stored in water production 230. Water from well 212 may be sent to water production 230. Processed water may be pumped down well 232, to fractured portions 234 of formation 206. Water traverses formation 206 to aid in the production of oil and gas, and then the water the oil and gas may be all produced to well 212, to production facility 210. Water may then be recycled, for example by returning water to water production 230, where it may be processed, then re-injected into well 232.

Hydrocarbons, such as oil and/or gas, may be recovered from the earth's subsurface formation 206 through production wellbore 212 that penetrate hydrocarbon-bearing formations or reservoirs. Perforations may be made from the production wellbore 206 to portions of the formation 214 to facilitate flow of the hydrocarbons from the hydrocarbon-bearing formations to the production wellbores. Water may be injected under pressure into injection zones 234 formed in the subsurface formation 206 to stimulate hydrocarbon production through the production wells in a field. Water may be injected by itself as a component of miscible or immiscible displacement fluids. Sea water (for offshore wells) and brine produced from the same or nearby formations (for onshore wells) may be used as the water source. Such water may contain amounts (concentration) of precursor ions, such as divalent sulfate ($SO_4^-$), which may form insoluble salts when they come in contact with cations, such as $Ba^{++}$, $Sr^{++}$ and $Ca^{++}$, resident in the formations. The resulting salts ($BaSO_4$, $SrSO_4$ and $CaSO_4$) can be relatively insoluble at subsurface formation temperature and pressure. Such salts may precipitate out of the solution. The precipitation of the insoluble salts may accumulate and consequently plug the subsurface fluid passageways. The plugging effects may be most severe in passageways in the formation near the injection well 232 and at the perforations of the production well 212. Solubility of the insoluble salts may further decrease as the injection water is produced to the surface through the production well 212, due to the reduction of the temperature and pressure as the fluids move to the surface through the production well. Subsurface or formation fluid passageways may include pores in the formation matrix, fractures, voids, cavities, vugs, perforations and fluid passages through the wells, including cased and uncased wells, tubings and other fluid paths in the wells. Precipitates may include insoluble salts, crystals or scale. Plugging may include reduction in the porosity and/or permeability of fluid passageways and the tubulars used in producing the well fluids and processing of those fluids. Injection water may include any fluid containing water that is injected into a subsurface formation to facilitate recovery of hydrocarbons from subsurface formations.

One purpose of injection well 232 is to aid the flow of hydrocarbons from the reservoir to production well 212. One method is to inject water under pressure adjacent to a production zone to cause the hydrocarbons trapped in the formation 206 to move toward the production well 212.

Figure 3:
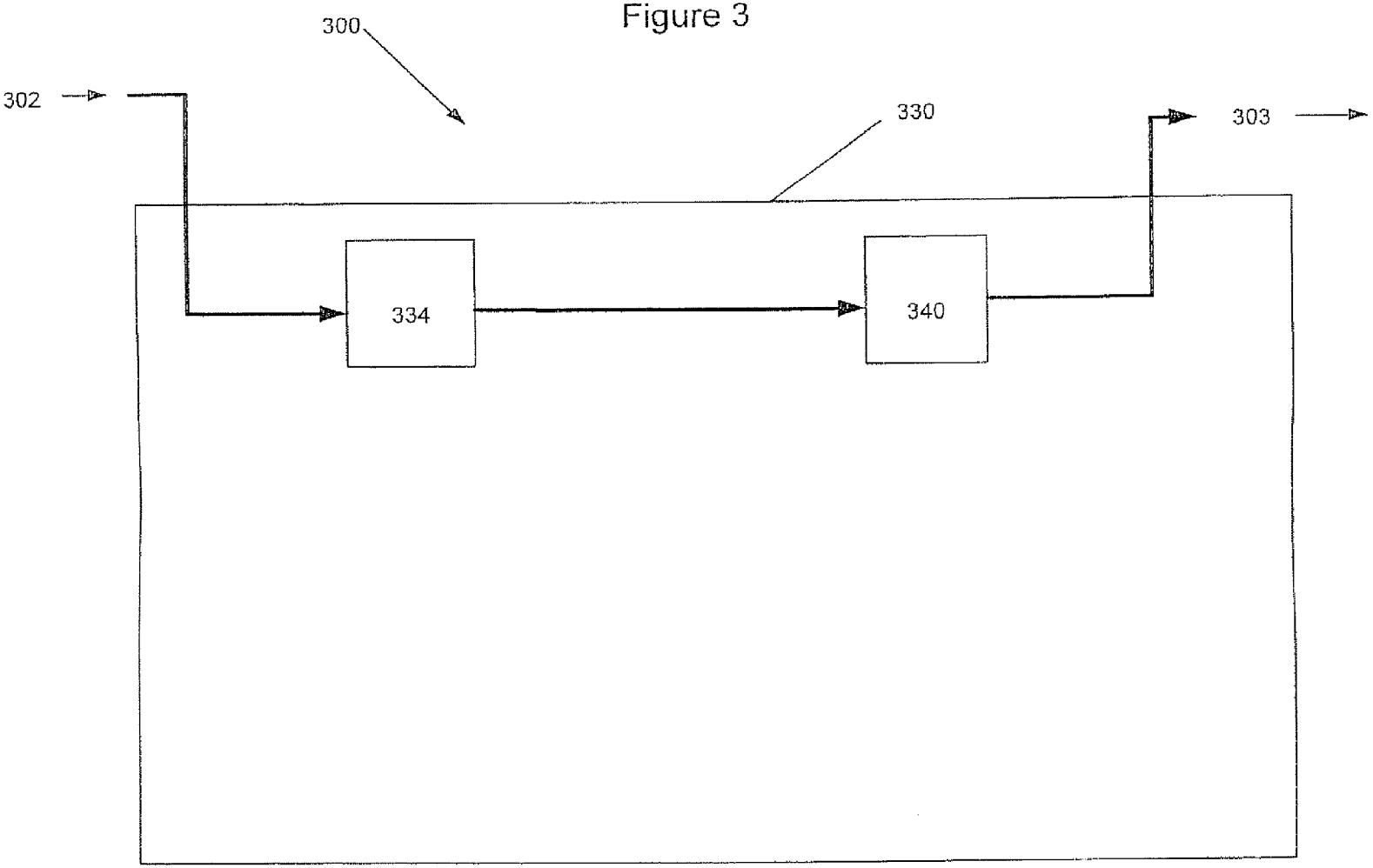
FIG. 3 illustrates a water processing system.

Referring now to FIG. 3, in some embodiments of the invention, a system 300 for water production 330 is illustrated. Water production 330 has an input of unprocessed water, for example water from a body of water, from a well, seawater, city water supply, or another water supply. At 334 some cations may be removed from raw water 302, for example multivalent cations, such as divalent or trivalent cations. At 340, monovalent cations may be removed from raw water 302. Processed water 303 is then produced from water production 330.

Figure 4:
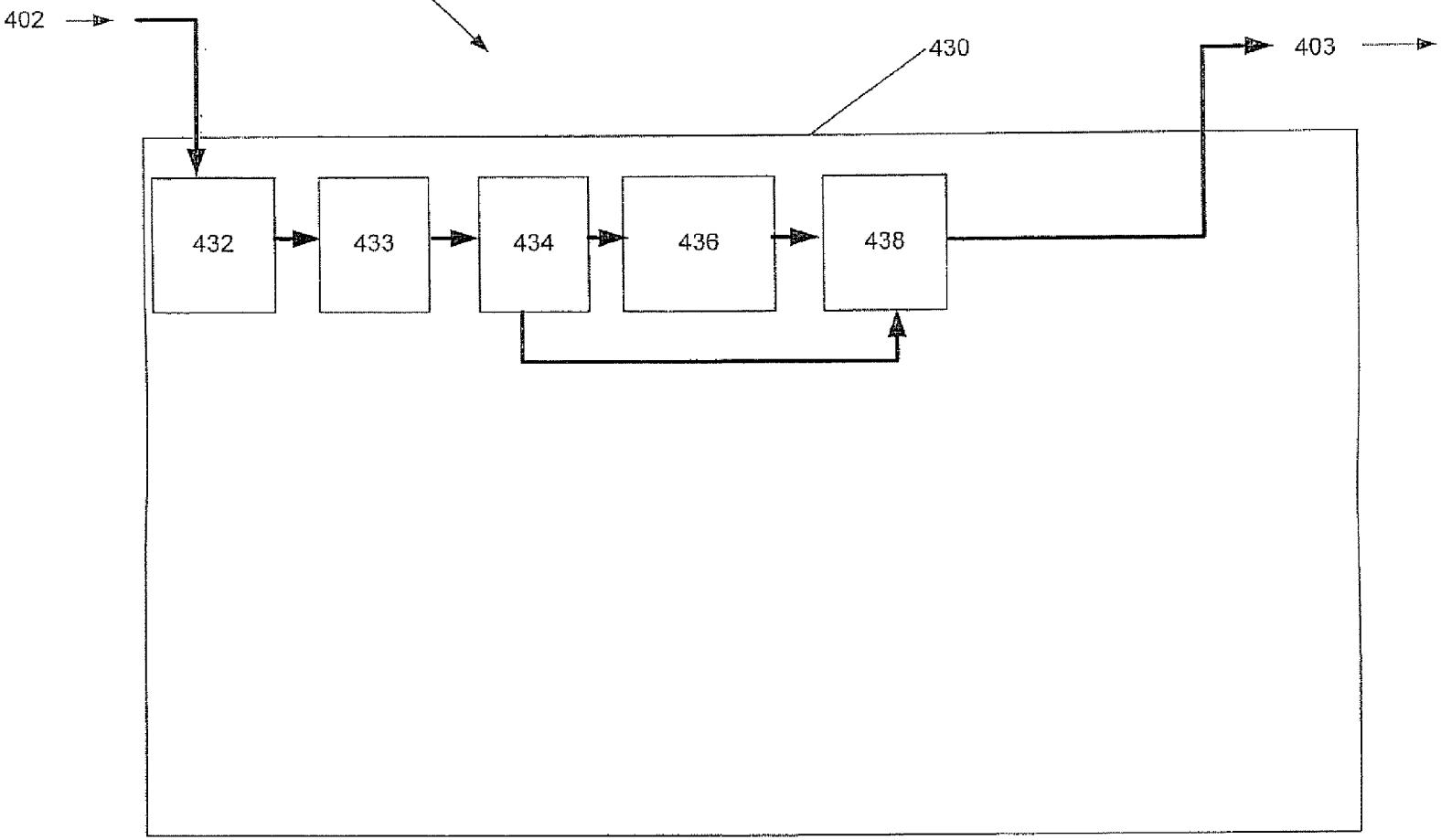
FIG. 4 illustrates a water processing system.

Referring now to FIG. 4, in some embodiments of the invention, system 400 for water production 430 is illustrated. Water production 430 has an input of unprocessed water 402, for example water from the body of water from a well, sea water, city water supply, or another water supply. At 432, primary filtration may be accomplished to remove solids from water. At 433 sulphates ($SO_4$) may be removed. At 434, some divalent cations may be removed, for example from about 60 to about 99% of the divalent cations present. Divalent cations which may be removed include magnesium (Mg), calcium (Ca), iron (Fe) and/or strontium (Sr).

In some embodiments, 433 and/or 434 may be performed with nanofiltration membrane systems.

At 436, some monovalent ions may be removed, for example from about 60 to about 99% of the cations present, such as sodium (Na), and/or potassium (K), along with the associated anions, for example chloride, fluoride, and/or bromide. At 438, some divalent cations may be added back to water, for instance adding back some magnesium, calcium, and/or strontium. Processed water 403 may be produced by water production 430.

In some embodiments, water production 330 and/or 430 may use a membrane based system, for example reverse osmosis (RO) and/or nanofiltration (NF) technology, such as are used for seawater desalination, filtration, and/or purification.

The driving force for permeation for membrane separation may be the net pressure across the membrane; this is defined as the feed pressure minus the permeate or back pressure, less the difference between the osmotic pressure of the feed and the osmotic pressure of the permeate.

U.S. Pat. No. 4,723,603 employs NF membranes for specific removal of sulfate from seawater. Sulfates may be removed by NF membranes, and the NF permeate, may be rich in sodium chloride but deficient in sulfate. Such sulfate-free water may prevent the formation of barium sulfate, which has low solubility and can cause clogging. U.S. Pat. No. 4,723,603 is herein incorporated by reference in its entirety.

U.S. Pat. No. 4,341,629 discloses desalinating seawater by using two RO modules, which can include the same membrane, e.g. a 90% rejection cellulose triacetate (CTA) RO membrane, or two different membranes, e.g. an 80% rejection CTA membrane and a 98% rejection CTA membrane. U.S. Pat. No. 4,341,629 is herein incorporated by reference in its entirety.

U.S. Pat. No. 5,238,574 discloses the use of a multiplicity of RO membrane modules to process seawater. For example, a first low-pressure RO membrane may be followed by a high pressure RO membrane, or a series of low pressure RO membranes can be used, to either provide permeate of varying water quality or simply to produce a combined permeate where the concentrate stream from one module becomes the feedstream for the next module in series. U.S. Pat. No. 5,238,574 is herein incorporated by reference in its entirety.

In some embodiments, system 400 may include unprocessed water 402, from an aqueous feed source such as seawater from the ocean, or any saline water source having some divalent and monovalent ions, such as produced water from a well. As one example, raw seawater may be taken from the ocean, either from a sea well or from an open intake, and initially subjected to primary filtration 432 using a large particle strainer (not shown), and/or multi-media filters, which might be typically sand and/or anthracite coal, optionally followed by a cartridge filtration.

In some embodiments, processes 433, 434, and/or 436 can include one or a plurality of RO cartridges which may be located downstream of one or a plurality of NF cartridges. RO cartridges and/or NF cartridges may be spirally wound semipermeable membrane cartridges, or cartridges made using hollow fiber technology having suitable membrane characteristics. For example, E. I. DuPont sells RO cartridges of hollow fine fiber (HFF) type, which are marketed by DuPont as their HFF B-9 cartridges and which may be used. A spirally wound semipermeable membrane cartridge may include a plurality of leaves which are individual envelopes of sheet-like semipermeable membrane material that sandwich therebetween a layer of porous permeate carrying material, such as polyester fibrous sheet material. The semipermeable membrane material may be any of those commercially available materials. Interleaved between adjacent leaves may be lengths of spacer material, which may be woven or other open mesh, screen-like crosswise designs of synthetic filaments, e.g. cross-extruded filaments of polypropylene or the like such as those sold under the trade names Vexar and Nalle, that provide flow passageways for the feed water being pumped from end to end through a pressure vessel. A lay-up of such alternating leaves and spacer sheets may then be spirally wound about a hollow tube having a porous sidewall to create a right circular cylindrical cartridge.

One spirally wound separation cartridge is disclosed in U.S. Pat. No. 4,842,736, the disclosure of which is incorporated herein by reference, which provides a plurality of spiral feed passageways which extend axially from end to end of the ultimate cartridge, through which passageways the feed liquid being treated flows in an axial direction. Internally within the membrane envelopes, the permeating liquid flows along a spiral path inward in a carrier material until it reaches the porous central tube where it collects and through which it then flows axially to the outlet.

In some embodiments, RO cartridges and/or NF cartridges may be selected so as to accomplish the desired overall function of producing a stream of processed water having the desired ionic concentrations from seawater or the like. RO elements or cartridges may be selected from suitable semipermeable membranes of the polyamide composite membrane variety, wherein a thin film of polyamide may be interfacially formed on a porous polysulfone support or the like that may be in turn formed on a highly porous fibrous backing material. RO membranes may be designed to reject more than about 95% of dissolved salts, for example about 98% or more.

Suitable commercially available RO membranes include those sold as AG8040F and AG8040-400 by Osmonics; SW30 Series and LE by Dow-FilmTec; as DESAL-11 by Desalination Systems, Inc.; as ESPA by Hydranautics; as ULP by Fluid Systems, Inc.; and as ACM by TriSep Corporation.

NF membranes may be employed which are designed to selectively reject divalent or larger ions, and the NF elements or cartridges which are used may reject a minimum of about 80%, for example more than about 90%, or about 95%, or about 98% of the divalent or larger ions in an aqueous feed. The NF membrane may also at least moderately reduces the monovalent ion content, for example less than about 70%, or less than about 50%, or less than about 30%, or less than about 20% of the monovalent ion content. Suitable commercially available NF membranes can be purchased either in sheet form or in finished spirally wound cartridges, and include those sold as SEASOFT 8040DK, 8040DL, and SEASAL DS-5 by Osmonics; as NF200 Series and NF-55, NF-70 and as NF-90 by Dow-Film Tec; as DS-5 and DS-51 by Desalination Systems, Inc., as ESNA-400 by Hydranautics; and as TFCS by Fluid Systems, Inc.

In some embodiments, a mechanical method, such as passing the unprocessed water 402 through a nano-filtration membrane, may be used to remove ions from the water at the surface before injecting it into the wellbore and/or adding an agent 440. Sea water may contain from about 2700 to about 2800 ppm of divalent $SO_4^-$. The nano-filtration membrane process may reduce this concentration 433 to about 20 to about 150 ppm. A 99% reduction in sulfate content may be achievable.

In some embodiments, chemicals and/or additives may be injected into the untreated water 402 to inhibit the in-situ growth of crystals from insoluble salt precipitation. A variety of additives are injected into the injection water at the surface or directly into an injection well. Production wells may also often be treated with back-flow of fresh brine containing additives to prevent plugging of the passageways.

In some embodiments, salt water may be processed 433, 434, and/or 436 by multistage flash distillation, multieffect distillation, reverse osmosis and/or vapor compression distillation. Membrane technologies have been used in the pretreatment of salt water to reduce the high ionic content of salt water relative to fresh water. Ion selective membranes may be used which selectively prevent certain ions from passing across it while at the same time allowing the water and other ions to pass across it. The selectivity of a membrane may be a function of the particular properties of the membrane, including the pore size or electrical charge of the membrane. Accordingly, any of the known and commercially available ion selective membranes which meet these criteria can be used. For example, a polyamide membrane is particularly effective for selectively preventing sulfate, calcium, magnesium and bicarbonate ions from passing across it, and could be used for processes 433 and/or 434. A polyamide membrane having the trade name SR90-400 (Film Tec Corporation) or HYDRANAUTICS CTC-1 may be used.

In some embodiments of the invention, unprocessed water 402 containing a high concentration of hardness ions (for example divalent cations) is passed through an ion selective membrane 434 to form a softened salt water having a reduced concentration of hardness ions. The softened salt water is fed to a desalination system 436. Then, some of the hardness ions may be added back to the water at 438.

Microfiltration (MF), ultrafiltration (UF), nanofiltration (NF), and reverse osmosis (RO) are all pressure-driven separation processes allowing a broad range of neutral or ionic molecules to be removed from fluids. Microfiltration may be used for removal of suspended particles greater than about 0.1 microns. Ultrafiltration may be used to exclude dissolved molecules greater than about 5,000 molecular weight. Nanofiltration membranes may be used for passing at least some salts but having high rejection of organic compounds having molecular weights greater than approximately 200 Daltons. Reverse osmosis membranes may be used for high rejection of almost all species. While NF and RO are both capable of excluding salts, they typically differ in selectivity. NF membranes commonly pass monovalent ions while maintaining high rejection of divalent ions. By contrast, reverse osmosis membranes are relatively impermeable to almost all ions, including monovalent ions such as sodium and chloride ions. NF membranes have sometimes been described as "loose" RO membranes. One suitable membrane capable of removing dissolved salts from water is the cellulose acetate membrane, with selectivity resulting from a thin discriminating layer that is supported on a thicker, more porous layer of the same material. Another suitable membrane is made of piperazine or substituted piperazine. Other suitable membranes include polymers such as the commercial FilmTec NF40 NF membranes.

In some embodiments, a spiral-wound filter cartridge may be used to incorporate large amounts of RO or NF membrane into a small volume. Such an element can be made by wrapping feed spacer sheets, membrane sheets, and permeate spacer sheets around a perforated permeate tube.

In some embodiments, interfacial polymerization may be used to make thin film composite membranes for RO and NF separations. This process is commonly performed as a polycondensation between amines and either acid chlorides or isocyanates.

Reverse osmosis membranes may have high rejection of virtually all ions, including sodium and chloride. NF membranes are often characterized as those having a substantial passage of neutral molecules having molecular weights less than 200 daltons and monovalent ions. NF membranes still commonly possess high rejection of divalent ions due to charge interactions. Membranes having a continuum of properties between RO and NF can also be produced. In addition to high rejection of at least one species, commercial membranes often possess high water permeability.

In some embodiments, membranes for RO and/or NF may be piperazine-based membranes, where at least 60% of amine-containing monomers incorporated into the polymer may be piperazine or piperazine derivative molecules. One typical example of a piperazine-based membrane is the FilmTec NF40 NF membrane, which has been made by contacting piperazine and TMC in the presence of an acid acceptor, N,N-dimethylpiperazine. The FilmTec commercial membranes NF45 and SR90 have been made by similar processes, with additional proprietary chemicals added to the water and/or organic phase. A particularly useful property of some membranes is the ability to selectively remove some molecules while retaining others. For example, the dairy industry has used piperazine-based membranes to concentrate large neutral molecules (whey and lactose) while removing minerals. In other cases it is desired to pass monovalent salts while maintaining high rejection of divalent ions.

In some embodiments, processes 334, 433, and/or 434 may use a NF device, such as a membrane. In some embodiments, processes 334 and/or 436 may use a RO device, such as a membrane.

In some embodiments of the invention, processed water 303 and/or 403 may be combined with one or more of the aromatics, for example, benzene, toluene, or xylene; turpentine; tetralin; chlorinated hydrocarbons, for example, carbon tetrachloride or methlyene chloride; or other hydrocarbons, for example $C_5$-$C_{10}$ hydrocarbons and/or alcohols; steam; or sulfur compounds, for example, hydrogen sulfide, and then injected into a formation for enhanced oil recovery. For example, a mixture of processed water with an agent for increasing the viscosity mixed with alcohol, may be injected into a formation.

The reduction of the monovalent cation level of an injection water may achieve one or more of the following benefits:

When oil is attached to the clay surface by the bridging of calcium to the clay and the oil drop, the addition of low salinity water may cause the calcium to diffuse into the bulk solution and liberate the oil droplet;

When oil is attached to the clay surface by the bridging of calcium to the clay and the oil drop, the addition of low salinity water may cause another ion to replace the calcium bonded to the clay, and liberate the oil droplet attached to the calcium by multivalent ion exchange;

The addition of low salinity water may cause a oil wet reservoir to convert into a water wet reservoir and release the oil;

Increased oil recovery for a reservoir; and

Increased oil recovery for a high salinity reservoir.

The addition of multivalent cations to an injection water may achieve one or more of the following benefits:

Reduced clay swelling;

Increased oil recovery for a reservoir; and

Increased oil recovery for a high salinity reservoir.

Water may be commonly injected into subterranean hydrocarbon-bearing formations by itself or as a component of miscible or immiscible displacement fluids to recover hydrocarbons therefrom. Unprocessed water 302 and/or 402 can be obtained from a number of sources including brine produced from the same formation, brine produced from remote formations, or sea water. All of these waters may have a high ionic content relative to fresh water. Some ions present in unprocessed water 302 and/or 402 can benefit hydrocarbon production, for example, certain combinations and concentrations of cations and anions, including $K^+$, $Na^+$, $Cl^-$, $Br^-$, and/or $OH^-$, can stabilize clay to varying degrees in a formation susceptible to clay damage from swelling or particle migration. Other ions (or the same ions that benefit hydrocarbon production) present in the unprocessed water 302 and/or 402 can produce harmful effects in situ, for example, divalent $SO_4^-$ anions in the injection water may be particularly problematic because $SO4^-$ may form salts with cations already present in the formation, such as $Ba^{++}$. The resulting salts can be relatively insoluble at the formation temperatures and pressures. Consequently they may precipitate out of solution in situ. Solubility of the salts further decreases as the injection water may be produced to the surface with the hydrocarbons because of pressure and temperature decreases in the production well. The precipitates of the insoluble salts may accumulate in subterranean fluid passageways as crystalline structures, which ultimately plug the passageways and reduce hydrocarbon production. The effects of plugging may be most severe in passageways located in the formation near wellbores and in production wells where it may be more difficult for the produced fluids to circumvent blocked passageways.

In some embodiments of the invention, processed water or a processed water mixture 303 and/or 403 may be injected into formation 206, produced from the formation 206, and then recovered from the oil and gas, for example, by a centrifuge or gravity separator, and then processing the water at water production 230, then the processed water or a processed water mixture 303 and/or 403 may be re-injected into the formation 206.

In some embodiments of the invention, processed water or a processed water mixture 303 and/or 403 may be injected into an oil-bearing formation 206, optionally preceded by and/or followed by a flush, such as with seawater, a surfactant solution, a hydrocarbon fluid, a brine solution, or fresh water.

In some embodiments of the invention, processed water or a processed water mixture 303 and/or 403 may be used to improve oil recovery. The processed water or a processed water mixture 303 and/or 403 may be utilized to drive or push the now oil bearing flood out of the reservoir, thereby "sweeping" crude oil out of the reservoir. Oil may be recovered at production well 212 spaced apart from injection well 232 as processed water or a processed water mixture 303 and/or 403 pushes the oil out of the pores in formation 206 and to the production well 212. Once the oil/drive fluid reaches the surface, it may be put into holding tanks 218, allowing the oil to separate from the water through the natural forces of gravity.

The amount of oil recovered may be measured as a function of the original oil in place (OOIC). The amount of oil recovered may be greater than about 5% by weight of the original oil in place, for example 10% or greater by weight of the original oil in place, or 15% or greater by weight of the original oil in place.

The process and system may be useful for the displacement recovery of petroleum from oil-bearing formations. Such recovery encompasses methods in which the oil may be removed from an oil-bearing formation through the action of a displacement fluid or a gas.

Other uses for the processed water or a processed water mixture 303 and/or 403 prepared by the process and system of the invention include near wellbore injection treatments, and injection along interiors of pipelines to promote pipelining of high viscosity crude oil. The processed water or a processed water mixture 303 and/or 403 can also be used as hydraulic fracture fluid additives, fluid diversion chemicals, and loss circulation additives, to mention a few.

Illustrative Embodiments

In one embodiment, there is disclosed a system comprising a well drilled into an underground formation comprising hydrocarbons; a production facility at a topside of the well; a water production facility connected to the production facility; wherein the water production facility produces water by removing some multivalent ions, then removing some monovalent ions, and then adding back some multivalent ions, and then injects the water into the well. In another embodiment, there is disclosed a system comprising a first well drilled into an underground formation comprising hydrocarbons; a production facility at a topside of a first well; a water production facility connected to the production facility; a second well drilled into the underground formation; wherein the water production facility produces water by removing some multivalent ions, then removing some monovalent ions, and then adding back some multivalent ions, and injects the water into the second well and into the underground formation. In some embodiments, the first well is a distance of 50 meters to 2000 meters from the second well. In some embodiments, the underground formation is beneath a body of water. In some embodiments, the production facility is floating on a body of water, such as a production platform. In some embodiments, the system also includes a water supply and a water pumping apparatus, adapted to pump water to the water production facility. In some embodiments, the water production facility has an input water having a total dissolved salts value of at least 15,000 parts per million, expressed as sodium chloride dissolved. In some embodiments, at least one well has been fractured with a viscous liquid and a propping agent such as sand.

In one embodiment, there is disclosed a method comprising removing some multivalent ions from water; removing some monovalent ions from water; adding some multivalent ions to the water; and injecting the water into an underground formation. In some embodiments, the processed water is recycled by being produced with oil and/or gas and separated, and then re-injected into the formation. In some embodiments, one or more of aromatics, chlorinated hydrocarbons, other hydrocarbons, water, carbon dioxide, carbon monoxide, or mixtures thereof are mixed with the processed water prior to being injected into the formation. In some embodiments, the processed water is heated prior to being injected into the formation. In some embodiments, the processed water is heated while within the formation. In some embodiments, the processed water is heated with hot water, steam and/or a non-aqueous liquid and/or gas injected into the formation. In some embodiments, removing some multivalent ions from water comprises removing some divalent cations. In some embodiments, another material is injected into the formation after the processed water was injected. In some embodiments, the another material is selected from the group consisting of air, produced water, salt water, sea water, fresh water, steam, carbon dioxide, and/or mixtures thereof. In some embodiments, the processed water is injected from 10 to 100 bars above the reservoir pressure. In some embodiments, the oil in the underground formation prior to water being injected has a viscosity from 5 cp to 10,000 cp. In some embodiments, the oil in the underground formation prior to water being injected has a viscosity from 500 cp to 5,000 cp. In some embodiments, the underground formation has a permeability from 5 to 0.0001 Darcy. In some embodiments, the underground formation has a permeability from 1 to 0.001 Darcy. In some embodiments, producing and/or injecting are done into a vertical and/or a horizontal well. In some embodiments, input water has a total dissolved salts value of at least 15,000 parts per million, expressed as sodium chloride dissolved, prior to the removing any ions from the water.

Those of skill in the art will appreciate that many modifications and variations are possible in terms of the disclosed embodiments, configurations, materials and methods without departing from their spirit and scope. Accordingly, the scope of the claims appended hereafter and their functional equivalents should not be limited by particular embodiments described and illustrated herein, as these are merely exemplary in nature.

The invention claimed is:

1. A system comprising:

a well drilled into an underground formation comprising hydrocarbons;

a production facility at a topside of the well;

a water production facility connected to the production facility, the water production facility comprising a pressure driven first membrane system comprising a nanofiltration membrane designed to selectively reject a greater percentage of multivalent cations than monovalent cations from a water source containing multivalent cations and monovalent cations, and a pressure driven second membrane system located downstream of the first membrane system, the second membrane system comprising a reverse osmosis membrane designed to remove from 60% to 99% of cations from a water source;

wherein the water production facility produces water by removing some multivalent cations from water containing multivalent cations and monovalent cations by passing the water through the first membrane system, by removing some monovalent cations from the water from which some multivalent cations have been removed by passing the water from which some multivalent cations have been removed through the second membrane system, and by adding back some multivalent cations to the water from which some of the monovalent cations have been removed, and then injects the produced water into the well.

2. The system of claim 1, wherein the underground formation is beneath a body of water.

3. The system of claim 1, wherein the production facility is floating on a body of water.

4. The system of claim 1, further comprising a water supply and a water pumping apparatus, adapted to pump unprocessed water to the water production facility.

5. The system of claim 1, wherein water is provided to the water production facility through an unprocessed water input, and the water provided to the water production facility has a total dissolved salts value of at least 15,000 parts per million, expressed as sodium chloride dissolved.

6. The system of claim 1, wherein at least one well has been fractured with a viscous liquid and a propping agent.

7. The system of claim 1 wherein the nanofiltration membrane is effective to reject at least 80% of multivalent ions and to reject less than 70% of monovalent ions.

8. A system comprising:

a first well drilled into an underground formation comprising hydrocarbons;

a production facility at a topside of a first well;

a water production facility connected to the production facility, the water production facility comprising a pressure driven first membrane system comprising a nanofiltration membrane designed to selectively reject a greater percentage of multivalent cations than monovalent cations from a water source comprising multivalent and monovalent cations, and a pressure driven second membrane located downstream of the first membrane system designed to remove from 60% to 99% of cations from a water source;

a second well drilled into the underground formation;

wherein the water production facility produces water by removing some multivalent cations from water containing multivalent cations and monovalent cations by passing the water through the first membrane system, removing some monovalent cations by passing the water through the second membrane system, and adding back some multivalent cations to the water after removal of some of the monovalent cations, and injects the produced water into the second well and into the underground formation.

9. The system of claim 8, wherein the first well is a distance of 50 meters to 2000 meters from the second well.

10. The system of claim 8 wherein the nanofiltration membrane is effective to reject at least 80% of multivalent ions and to reject less than 70% of monovalent ions.

11. A method comprising:

removing some multivalent cations from water by passing the water through a first membrane;

removing some monovalent cations from the water by passing the water from which some multivalent cations have been removed through a second membrane, the second membrane comprising a reverse osmosis membrane effective to remove from 60% to 99% of cations from the water passed through the second membrane;

adding some multivalent cations to the water from which some monovalent cations have been removed and from which some multivalent cations have been removed to produce processed water; and injecting the processed water into an underground formation.

12. The method of claim 11, wherein the processed water is recycled by being produced with oil or gas, separated from the oil or gas, and then re-injected into the formation.

13. The method of claim 11, wherein one or more of aromatics, chlorinated hydrocarbons, other hydrocarbons, water, carbon dioxide, carbon monoxide, or mixtures thereof are mixed with the processed water prior to being injected into the formation.

14. The method of claim 11, wherein the processed water is heated prior to being injected into the formation.

15. The method of claim 11, wherein the processed water is heated while within the formation.

16. The method of claim 15, wherein the processed water is heated with hot water, steam or a non-aqueous liquid or gas and injected into the formation.

17. The method of claim 11, wherein removing some multivalent cations from water comprises removing some divalent cations.

18. The method of claim 11, wherein a material is injected into the formation after injection of the processed water.

19. The method of claim 18, wherein the material injected into the formation after injection of the processed water is selected from the group consisting of air, produced water, salt water, sea water, fresh water, steam, carbon dioxide, and mixtures thereof.

20. The method of claim 11, wherein the processed water is injected into the formation at a pressure of from 10 to 100 bars above the reservoir pressure.

21. The method of claim 11, wherein the oil in the underground formation has a viscosity from 5 cp to 10,000 cp prior to the water being injected.

22. The method of claim 11, wherein the oil in the underground formation has a viscosity from 500 cp to 5,000 cp prior to the water being injected into the formation.

23. The method of claim 11, wherein the underground formation has a permeability from 5 to 0.0001 Darcy.

24. The method of claim 11, wherein the underground formation has a permeability from 1 to 0.001 Darcy.

25. The method of claim 11, wherein producing or injecting are done into a vertical or a horizontal well.

26. The method of claim 11, wherein the water from which some multivalent cations are removed by passing the water through a first membrane has a total dissolved salts value of at least 15,000 parts per million, expressed as sodium chloride dissolved, prior to the removing any cations from the water.

27. A method of enhanced oil recovery, comprising:

removing some sulfates from water;

removing some divalent cations from the water after removing some sulfates from the water by passing the water through a nanofiltration membrane;

removing some monovalent cations from the water from which some divalent cations have been removed by passing the water through a reverse osmosis membrane;

adding some multivalent cations to the water from which the monovalent cations have been removed; and then injecting the water into an underground oil containing formation.

28. The method of claim 27, wherein the multivalent cations added to the water from which the monovalent cations have been removed are divalent cations.

29. A method of enhanced oil recovery, comprising:

removing some cations from water with a nano-filtration process to produce water having some cations removed and a nano-filtration reject stream containing cations removed from the water;

removing some additional cations from the water with a reverse osmosis process;

adding back some of the removed cations to the water prior to injecting the water into the formation by adding a portion of a nano-filtration reject stream to the water; and injecting the water into an underground oil containing formation.

* * * * *